United States Patent [19]

Moji

[11] Patent Number: 4,767,362

[45] Date of Patent: Aug. 30, 1988

[54] ELECTROMAGNETIC WAVE INTERFERENCE PREVENTION DEVICE FOR MULTIELECTRODE CONNECTOR

[76] Inventor: Eirou Moji, 219, Iguchi, Mitaka-shi, Tokyo, Japan

[21] Appl. No.: 46,900

[22] Filed: May 5, 1987

[51] Int. Cl.[4] ..... H01R 13/658

[52] U.S. Cl. ..... 439/610; 439/449

[58] Field of Search ..... 439/607, 609, 610, 449, 439/455, 457, 458

[56] References Cited

U.S. PATENT DOCUMENTS 4,433,206 2/1984 Lewis ..... 439/610 X

*Primary Examiner*—Eugene F. Desmond

*Attorney, Agent, or Firm*—Browdy and Neimark

[57] ABSTRACT

An electromagnetic wave interference prevention device is disclosed, which is used in a multielectrode connector comprising a cylindrical outer sleeve made of a meal member, a molding fitted in the outer sleeve and consisting of a synthetic resin material in the form of a plug and a plurality of contacts held in the molding, core wires of a plurality of cord lines of a cord covered by an outer cover and shield wires. The device comprises a cord clamp consisting of a metal member in the form of a lid closing the rear open end of the outer sleeve. The cord clamp is fitted on the outer periphery of an end portion of the outer cover of the cord and integrally coupled to the cord. The cord clamp is integrally assembled to a rear end of the outer sleeve such as to close the rear open end of the other sleeve.

1 Claim, 5 Drawing Sheets

ELECTROMAGNETIC WAVE INTERFERENCE PREVENTION DEVICE FOR MULTIELECTRODE CONNECTOR

BACKGROUND OF THE INVENTION

1. Field of the Invention

This invention relates to improvements in an electromagnetic wave interference prevention device for a multielectrode connector, which prevents leakage of electromagnetic waves from the periphery of a plurality of cord lines connected to respective contacts held in a connector body.

2. Description of the Prior Art

FIG. 1 shows a multielectrode connector A. As is shown, in an outer sleeve 1 consisting of a cylindrical metal member a molding 3 of a synthetic resin member holding a plurality of contacts 3 is fitted like a plug. Core wires 42*a* of a plurality of cord lines 42 wrapped in an outer cover 40 and shield wires 41 of a cord 4 are connected to the rear ends (right ends in FIG. 1) of the contacts 2 held in the molding 3. A cover 5 consisting of a synthetic resin member is fitted on a range from a rear half of the outer sleeve 1 to a front end portion of the outer cover 40 of the cord 4. When connecting the individual cord lines 42 of the cord 4 to the rear ends of the contacts 2 held in the molding 3, the cord lines 42 are exposed by stripping the shield wires 41. Therefore, the shield is insufficient in the neighborhood of the connection region, leading to electromagnetic wave interference.

There are various means for preventing the electromagnetic wave interference. In either case, complication of the fabrication is increased. In addition, the components are increased to increase the assembly steps and also increase the size of the overall multielectrode connector.

SUMMARY OF THE INVENTION

An object of the present invention has been intended in order to overcome the above problems, and its object is to provide novel means, which can reliably prevent the electromagnetic wave interference without increasing the number of components.

According to the present invention, there is provided, in a multielectrode connector comprising a cylindrical outer sleeve made of a metal member, a molding fitted in the outer sleeve and consisting of a synthetic resin material in the form of a plug and a plurality of contacts held in the molding, core wires of a plurality of cord lines of a cord covered by an outer cover and shield wires, an electromagnetic wave interference prevention device comprises a cord clamp consisting of a metal member in the form of a lid closing a rear open end of the outer sleeve, the cord clamp being fitted on the outer periphery of an end portion of the outer cover of the cord and integrally coupled to the cord, the cord clamp being integrally assembled to a rear end of the outer sleeve such as to close the rear open end of the outer sleeve.

BRIEF DESCRIPTION OF THE DRAWINGS

The object and feature of the invention will become apparent from the following description of a preferred embodiment of the invention with reference to the accompanying drawings, in which.

DETAILED DESCRIPTION OF THE PREFERRED EMBODIMENT

Figure 1:
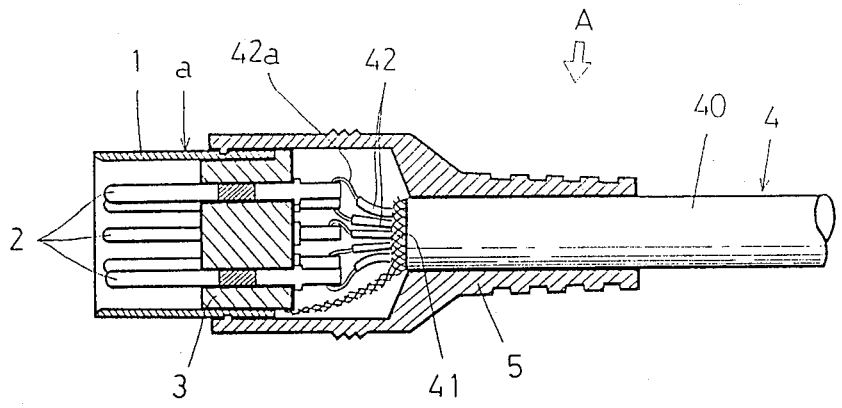
FIG. 1 is an axial sectional view showing a prior art multi-electrode connector.

In the Figures, components having the same effects as those in the prior art means described above are designated by like reference numerals.

Figure 2:
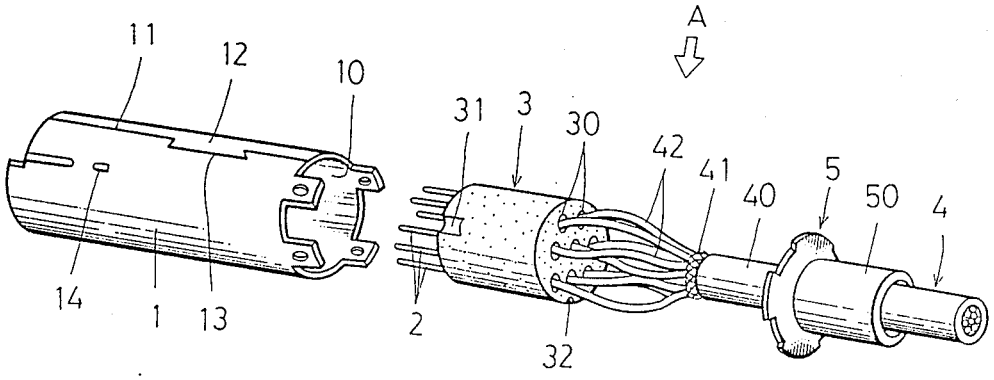
FIG. 2 is a perspective view showing a multielectrode connector in the course of assembly according to the present invention.

FIG. 2 is a perspective view showing a multielectrode connector A being assembled for carrying out the present invention. Reference numeral 1 designates an outer sleeve serving as outer electrode and consisting of a cylindrical metal plate, 3 a molding of a synthetic resin material fitted like a plug in the outer sleeve 1, 2 contacts inserted through and held in respective through holes 30 formed in the molding 3, 4 a cord having cord lines 42 connected to connection terminals of the contacts 2 on the rear end side (right end side in FIG. 2) thereof, 5 a cord clamp having a lid-like form for closing a rear open end 10 of the outer sleeve 1.

Figure 7:
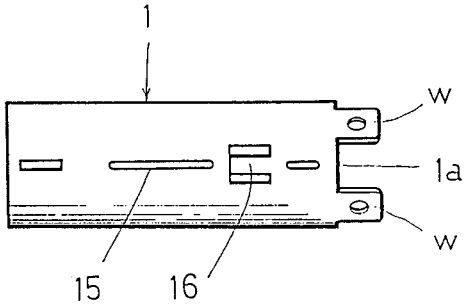
FIG. 7 is a bottom view of the outer sleeve of the multielectrode connector.
Figure 8:
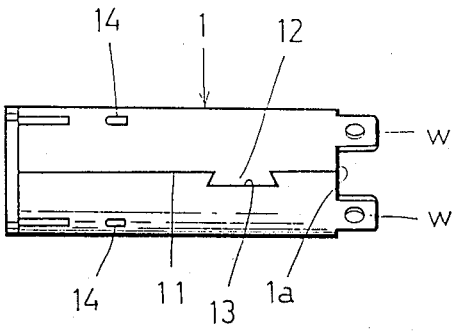
FIG. 8 is a top view showing the outer sleeve of the multielectrode connector.
Figure 9:
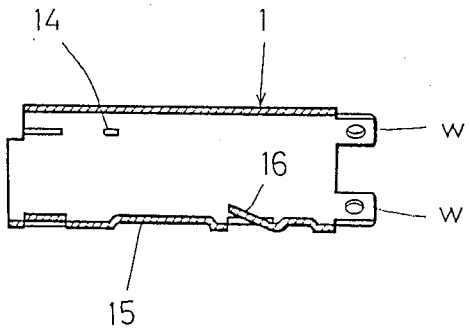
FIG. 9 is an axial sectional view showing the outer sleeve of the multielectrode connector.

The outer sleeve 1 is formed by processing a steel plate stampted to a predetermined shape and having a spring character with a press into a cylindrical shape. Axial but faces 11 of the stamped steel plate, which are abutted when the steel plate is formed into the cylindrical shape, are respectively provided with a wedge-like engagement projection 12 and a notch 13 having a complementary shape. The inner periphery of the sleeve 1 near the front end is provided with stoppers 14 in the form of short ribs (FIG. 8) for restricting the position of the molding 3 fitted in the sleeve 1. The bottom portion of the sleeve 1 opposite to the butt faces 11 is provided with a guide rib 15 serving as a guide when inserting the molding 3 and also with a stopper pawl 16 for restricting the return of the fitted molding 3 (FIGS. 7 and 9).

Engagement pawl pieces w extend from the rear end of the outer sleeve 1. They are formed integrally with the steel plate when stamping the steel plate material. As shown in FIGS. 7 and 8, they extend rearwardly from the rear end 1*a* of the outer sleeve 1. As shown in FIGS. 7 and 8, the engagement pawl pieces w are provided at positions dividing the circumference of the rear end of the outer sleeve 1 into four uniform sections. Of these engagement pawl pieces w, adjacent two are provided on the opposite sides of the butt faces 11 (FIG. 8).

The molding 3 has axial through holes 30 (extending to the left and right in FIG. 10), in which the contacts 2 are inserted and held. The front end (left end in FIG. 1) of the outer periphery of the sleeve 1 are provided with recesses 31, in which the stoppers 14 are engaged. The outer periphery of the molding 3 is also formed with an axial guide groove 32 open at the opposite ends, in which the guide rib 15 noted is engaged.

Figure 3:
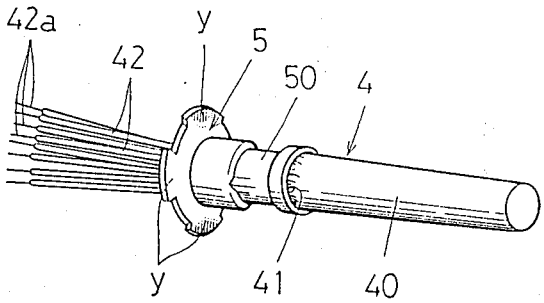
FIG. 3 is a perspective view for explaining a state in which a cord clamp of the multielectrode connector is secured to a cord.
Figure 4:
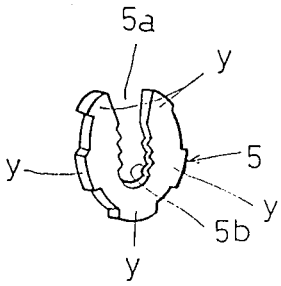
FIG. 4 is a perspective view showing a modification of the cord clamp used for the multielectrode connector.

The cord clamp 5 is a metal member in the form of a flange having radial projections as shown in FIG. 2. It is formed at one axial end of a cylindrical member 50 which is slidably fitted on the outer periphery of an outer cover 40 of the cord 4. The cylindrical member 50 is fitted on and moved along the cord 4 up to a predetermined position, at which shield wires 41 having been folded up are covered. In this state, the cylindrical member 50 is crushed with a suitable tool so that it is pressed on and integrally coupled to the outer periphery of the outer cover 40 of the cord 4, as shown in FIG. 3. FIG. 4 shows a modification of the cord clamp 5. This cord clamp 5 is a C-shaped metal member having a gap portion 5a. It is fitted from the gap portion **5*a* on the outer periphery of the outer cover 40 of the cord 4, and then the gap portion 5*a* is closed. In consequently, the inner periphery of a central portion 5*b* wedges on the outer periphery of the outer cover 40 of the cord 4, whereby the cord clamp is tightly integrally coupled to the cord 4**.

Figure 5:
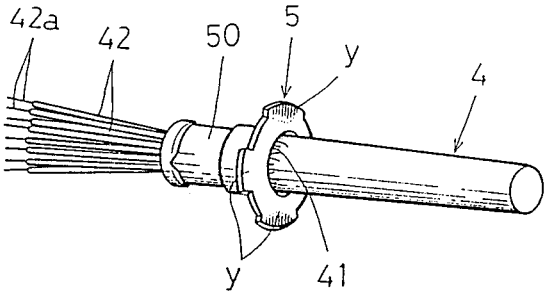
FIG. 5 is a perspective view showing a modification of means for securing the multielectrode connector to the cord.

Further, the cord clamp 5 with the cylindrical member 50 may be tightly fitted on the outer periphery of the outer cover 40 of the cord 4 with the cylindrical member 50 on the front side, as shown in FIG. 5.

Figure 6:
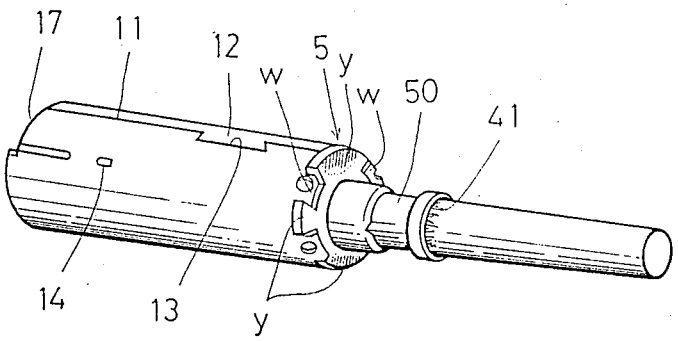
FIG. 6 is a perspective view showing a state in which the cord clamp of the multielectrode connector is assembled to an outer sleeve.

The cord clamp 5 is formed to have a shape and a size such that it serves as a lid to close the rear open end 10 of the outer sleeve 1 when it is joined to the rear end **1*a* of the outer sleeve 1 by moving it together with the cord 4 toward the outer sleeve 1 by inserting the molding 3 holding the contacts 2 having been connected to the cord lines 42 into the outer sleeve 1 when it is secured to the outer periphery of the outer cover 40 of the cord 4. As shown in FIGS. 2 and 3, the outer periphery of the cord clamp 5 has radially spacedapart outer projections y provided at positions uniformly dividing the circumference of the cord clamp 5 into four sections. Each of the outer projections y has a width to be closely engaged in the gap between adjacent engagement pawl pieces w provided at the rear end of the outer sleeve 1 and has a height such that the projecting end overlaps at least the rear end 1*a* of the outer sleeve 1 with the cord clamp 5 joined to the rear end of the outer sleeve 1 as shown in FIG. 6. The outer projections y provided on the outer periphery of the cord clamp 5 are fitted in gaps between adjacent engagement pawl pieces w of the outer sleeve 1 so that the cord clamp 5 is not rotated in the circumferential direction relative to the outer sleeve 1. The number of the outer projections y corresponds to the number of engagement pawl pieces w formed on the rear end of the outer sleeve 1**.

When the cord clamp 5 is as shown in FIG. 4, having the gap portion **5*a*, the molding 3 holding the contacts 2 connected to the core wires 42*a* of the cord lines 42 of the cord 4 is inserted into the outer sleeve 1 with the cord clamp 5 tightly fitted on the outer periphery of the outer cover 40 of the cord 4, the cord clamp 5 is joined to the rear end of the outer sleeve 1, and the outer projections y are fitted in the gaps between adjacent engagement pawl pieces w such that the position of the gap portion 5 of the cord clamp 5 is shifted in phase in the circumferential direction with respect to the butt faces 11 of the outer sleeve 1**.

The cord clamp 5 joined to the rear end of the outer sleeve 1 is integrally assembled on the outer sleeve 1 by caulking each engagement pawl piece w of the outer sleeve 1 to the outer side (rear side) of the cord clamp 5 as shown in FIG. 6.

In the illustrated embodiment of the device, reference numeral 7 designates a synthetic resin cover molded on a region from the outer periphery of the rear half of the outer sleeve 1 to the outer periphery of an end portion of the cord 4, and 17 a positioning notch serving as a positioner when inserting the front end of the outer sleeve 1 into the corresponding part of the multielectrode connector.

The embodiment of the device having the above construction has the following function.

Figure 10:
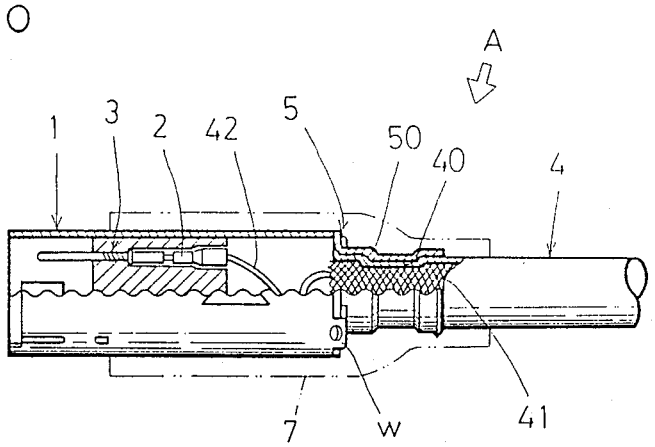
FIG. 10 is a side view, partly broken away, showing the multielectrode connector in the assembled state.
Figure 11:
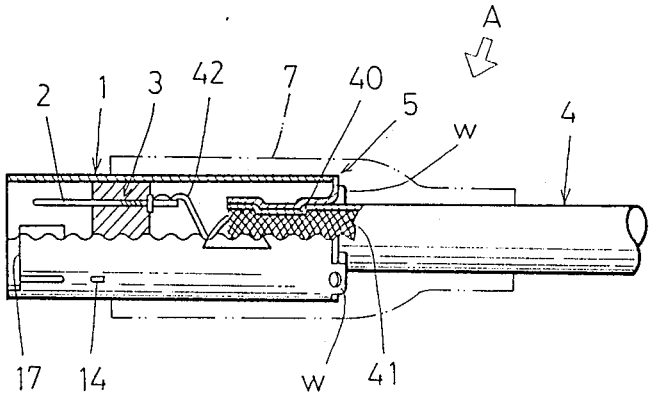
FIG. 11 is a side view, partly broken away, showing a modification of the multielectrode connector.

The cord clamp 5 which is secured to the rear end of the outer sleeve 1 consists of a metal member and close wires the rear open end 10 of the outer sleeve 1. Thus, the cord lines 42 taken out from the shield wires 41 of the cord 4 and connected to the rear ends of the contacts 2 and connection regions between the core wires **42*a* of the cord lines 42 and the contacts 2 are confined in and in cooperation with the outer sleeve 1, as shown in FIGS. 10 and 11**, so that it is possible to reliably prevent the leakage and intrusion of electromagnetic waves.

The cord clamp 5 having the inner wall of its central hole portion **5*b* is integrally fitted on the outer periphery of the outer cover 40 of the cord 4. Also, it is integrally coupled to the rear end of the outer sleeve 1 serving as a body of the connector body a of the multielectrode connector A. Thus, it is possible to reliably prevent the cord 4 to be withdrawn relative to the connector body a when the stem end side of the cord 4** is strongly pulled with the multielectrode connector A coupled to the opposite side connector.

As has been described in the foregoing, with the electromagnetic wave interference prevention device in the multielectrode connector according to the present invention, the cord clamp 5 provided to retaining the cord 4 against detachment is made of a metal member and assembled to the rear end of the outer sleeve 1 like a lid closing the rear open end 10 of the outer sleeve 1, whereby the plurality of contacts 2 held in the molding 3 and connection regions between the shield lines 41 of the cord 4 and a plurality of cord lines 42 taken out from the shield wires 41 of the cord 4 are perfectly covered by the metal member in cooperation with the cord clamp 5 and outer sleeve 1. Thus, it is possible to retain the cord 4 against detachment and reliably prevent electromagnetic wave interference by merely assembling the cord clamp 5 for retaining the cord 4 and without use of any particular part for electromagnetic wave interference prevention or increasing the number of assembly steps.

What is claimed is:

1. In a multielectrode connector including a cylindrical outer sleeve made of a metal member, a molding fitted in said outer sleeve and consisting of a synthetic resin material in the form of a plug and a plurality of contacts held in said molding, core wires of a plurality of cord lines of a cord covered by an outer cover and shield wires, an electromagnetic wave interference prevention device for a multielectrode connector comprising said cylindrical outer sleeve having axial butt faces and first engagement pawls at a rear end thereof, a cord clamp consisting of a metal member having a cylindrical portion and a flange portion formed integrally with said cylindrical portion in the form of a lid closing a rear open end of said outer sleeve, said flange portion having second engagement pawls on an outer periphery thereof without joint or crack portion, said second engagement pawls being closely engaged in gaps between said first engagement pawls, respectively, said cord clamp being fitted on the outer periphery of an end portion of the outer cover of said cord and integrally coupled to said cord, said cord clamp being integrally assembled to a rear end of the outer sleeve such as to close the rear open end of said outer sleeve.

* * * * *